US007025106B2

(12) United States Patent
Donnelly

(10) Patent No.: US 7,025,106 B2
(45) Date of Patent: Apr. 11, 2006

(54) AUTOMATICALLY-CLOSING SCREEN DOOR AND CLOSING SPEED ADJUSTER FOR THE SAME

(76) Inventor: John D. Donnelly, 99 Radny Dr., Lowell, MI (US) 49331

( * ) Notice: Subject to any disclaimer, the term of this patent is extended or adjusted under 35 U.S.C. 154(b) by 21 days.

(21) Appl. No.: 10/604,349

(22) Filed: Jul. 14, 2003

(65) Prior Publication Data

US 2004/0104001 A1 Jun. 3, 2004

Related U.S. Application Data

(60) Provisional application No. 60/319,752, filed on Dec. 4, 2002, provisional application No. 60/319,397, filed on Jul. 15, 2002.

(51) Int. Cl.
*E05F 1/02* (2006.01)

(52) U.S. Cl. ..... 160/90; 49/404; 16/81

(58) Field of Classification Search ..... 160/90, 160/96, 371; 16/81, 85; 49/404, 405, 447
See application file for complete search history.

(56) References Cited

U.S. PATENT DOCUMENTS

| | | | | |
|---|---|---|---|---|
| 4,003,102 | A * | 1/1977 | Hawks et al. | 16/72 |
| 4,651,469 | A * | 3/1987 | Ngian et al. | 49/223 |
| 4,891,911 | A * | 1/1990 | Yung | 49/404 |
| 6,397,530 | B1 * | 6/2002 | Terry et al. | 52/204.1 |
| 2001/0054260 | A1 * | 12/2001 | Plum et al. | 49/447 |

* cited by examiner

*Primary Examiner*—Blair M. Johnson
(74) *Attorney, Agent, or Firm*—McGarry Bair PC

(57) ABSTRACT

An automatically-closing screen door is provided that is typically for enclosure with a conventional sliding glass door used for patio entry in residential and/or commercial dwellings. The automatically-closing screen door preferably has a counterweight that is employed to provide a controllable closing force to the door.

18 Claims, 10 Drawing Sheets

AUTOMATICALLY-CLOSING SCREEN DOOR AND CLOSING SPEED ADJUSTER FOR THE SAME

CROSS REFERENCE TO RELATED APPLICATIONS

This application claims the benefit of U.S. Provisional Application Ser. No. 60/319,397, filed Jul. 15, 2002, and U.S. Provisional Application Ser. No. 60/319,752, filed Dec. 4, 2002, both entitled "Automatically-Closing Screen Door and Closing Speed Adjuster for the Same."

BACKGROUND OF INVENTION

1. Field of the Invention

The invention relates to an automatically-closing screen door, typically for enclosure with a conventional sliding glass door used for patio entry in residential and/or commercial dwellings. More particularly, the invention relates to an automatically-closing screen door in which a counterweight is employed to provide a controllable closing force to the door.

2. Description of the Related Art

Sliding glass door assemblies have become commonplace in both residential and commercial dwellings. A sliding door is mounted on a horizontal track in offset alignment with a fixed door. When an occupant of a dwelling desires to enter or leave the dwelling, the occupant slides the sliding door along the track to open and close the sliding door with respect to the fixed door.

In addition to having a sliding glass door, many sliding glass door assemblies have a sliding screen door as well mounted for sliding movement on a track that is generally parallel to the horizontal track for the sliding glass door. The sliding screen door allows the sliding glass door to be left in an opened position to allow airflow into the dwelling while preventing insects and other undesirable entities from entering the dwelling.

Sliding screen doors are typically moved between opened and closed positions by an occupant grasping a handle on the screen door and manually sliding the sliding screen door between the opened and closed positions. This is acceptable if the sliding screen door is maintained in the closed position.

However, if the sliding screen door is left in an open position, the sliding screen door does not return to the closed position on its own accord. This can be a problem if the occupant has young children who frequently forget to close the sliding screen door after entering or leaving the dwelling. In addition, if the occupant is entering or leaving the dwelling carrying an object or performing an activity that requires both of the occupant's hands (e.g., carrying trays of food), it may also be difficult to manually close the sliding screen door in an acceptable amount of time.

One solution to these problems has been to add a spring (e.g., a coil spring or a bungee cord) which is attached at one end to the sliding screen door and at an opposite end to a frame surrounding the sliding screen door. The spring thereby biases the sliding screen door to the closed position.

These spring-based automatic closure systems have some problems. First, the resistance on the screen door increases as you open the door since the return force of a spring-based system is proportional to the length it is extended (see Hooke's law where the spring force $F=kx$). Second, when a spring-based automatic closure system is released so that it travels from the opened position to the closed position, it can close very quickly as a result of the conversion of the potential energy stored in the extended spring into the kinetic energy as the sliding screen door moves toward the closed position. Third, repair of these so-called spring-based automatic closure systems can be difficult and costly. Fourth, the spring used in the so-called spring-based automatic closure system can lose elasticity over time and require replacement.

SUMMARY OF INVENTION

In one aspect, the invention relates to an automatically-closing screen door, typically for enclosure with a conventional sliding glass door used for patio entry in residential and/or commercial dwellings. More particularly, the invention relates to an automatically-closing screen door in which a counterweight is employed to provide a controllable closing force to the door. In one embodiment, the sliding screen door described herein according to the invention includes an adjuster which allows an occupant to adjust a closing velocity of the door.

Invention overcomes the limitations of the prior art by offering a simple manufacture, assembly and operation. It has a low profile relative to the door jamb, has a low cost to manufacture and has little resistance when opening the sliding screen door.

One aspect, the invention relates to a door slidable between a door open position permitting travel therethrough and a door closed position obstructing travel therethrough comprising a door frame defining a central opening therein through which ingress and egress can occur; and an automatic closure system comprising: a cable with a first end and a second end, wherein the first end is mounted to an upper portion of the sliding door; a counterweight connected at the second end of the cable and movable between a counterweight open position when the sliding door is in the door open position and a counterweight closed position when the sliding door is in the door closed position, wherein the counterweight open position is above the counterweight closed position; and a pulley mounted to the door frame for redirecting the cable from a generally horizontal orientation near the first end to a generally vertical orientation near the second end; wherein when a force is applied to the sliding door to cause the sliding door to slide to the door open position, the counterweight is elevated from the counterweight closed position to the counterweight open position by virtue of the attachment of the cable to the sliding door via the pulley, and when the force is released, the counterweight descends to the counterweight closed position thereby returning the sliding door to the door closed position.

Another aspect, the invention relates to a kit for adapting a sliding door mounted within a door frame to automatically move between a door open position permitting travel therethrough and a door closed position obstructing travel therethrough, the kit comprising: a cable with a first end and a second end, wherein the first end is adapted to be mounted to the sliding door; a counterweight adapted to be connected at the second end of the cable and movable between a counterweight open position when the sliding door is in the door open position and a counterweight closed position when the sliding door is in the door closed position; and a pulley adapted to be mounted to the door frame for redirecting the cable from a generally horizontal orientation near the first end to a generally vertical orientation near the second end; wherein, when the pulley is mounted to the door frame and when the first end of the cable is mounted to the sliding door, passed through the pulley and has its second end mounted to the counterweight, the sliding door will automatically move between the door open position and the door closed position after a force is applied to the sliding door to cause the sliding door to move to the door open position whereby when the force is released, the counterweight descends to the counterweight closed position thereby moving the sliding door to the door closed position.

Embodiments of the invention are also contemplated. The automatic closure system further can comprise a bracket mounted to the upper portion of the sliding door, wherein the cable is mounted to the bracket. The sliding door can be a screen door. The cable can be made from nylon. The pulley can be a wheel-type pulley. The pulley can be a complex pulley system.

The door frame can comprise a door jamb and the automatic closure system can further comprise a cover mounted on the door jamb to visually conceal the pulley, the second end of the cable, and the counterweight. The counterweight can have a thin profile so that the counterweight can easily be concealed under the cover. The counterweight can be at least one of a lead plate, a lead rod, a lead member, a lead-filled tube and a stainless steel member. The cover can have an opening to permit the cable to pass through the cover. The cover can have an elongated shape so that the cover can have an appearance similar to and blends in with the door jamb.

The automatic closure system can further comprise an adjuster to control movement of the counterweight between the counterweight open and counterweight closed positions. The adjuster can comprise a housing and a U-shaped member fastened to the housing, wherein the cable is received within the U-shaped member. The U-shaped member can be selectively moved toward the housing to constrict the cable between the U-shaped member and the housing, thereby restricting movement of the cable through the adjuster, retarding movement of the counterweight, and causing the sliding door to slide more slowly to the door closed position. The U-shaped member can be selectively moved away from the housing to loosen the cable, thereby causing the sliding door to slide at a faster rate to the door closed position. The adjuster can further comprise thumb screws to move the U-shaped member relative to the housing.

The door frame can comprise a door jamb, the automatic closure system can further comprise a cover mounted on the door jamb to visually conceal the pulley, the second end of the cable, and the counterweight, and the adjuster is mounted to one of the door jamb and the cover. The door frame can comprises a door jamb; the automatic closure system further comprises a cover mounted on the door jamb to visually conceal the pulley, the second end of the cable, the counterweight, and the adjuster; and wherein the adjuster comprises an arm having a first end mounted to the cover and a second end that extends towards the door jamb and abuts the counterweight as it moves between the counterweight open and counterweight closed positions, wherein the second end of the arm imparts a damping force onto the counterweight as it moves between the counterweight open and counterweight closed positions, thereby causing the sliding door to move more slowly between the door open position and the door closed position.

The adjuster can further comprise a bias adjuster to control the damping force imparted onto the counterweight by the arm. The bias adjuster can comprise a threaded fastener that is mounted through the cover and contacts the arm between the first and second ends of the arm so that movement of the threaded fastener towards the arm increases the amount of damping force exerted by the arm and movement of the threaded fastener away from the arm decreases the amount of damping force exerted by the arm. The arm can be comprised of a resilient material.

The adjuster can further comprise a spring mounted between the cover and the second end of the arm, wherein the spring biases the arm towards the counterweight. The automatic closure system can further comprise a cable brake to stop movement of the cable to retain the sliding door in the door open position or in the door closed position. The cover can have an opening to permit the cable to pass through the cover, and the cable brake can comprise a flange mounted to the cover near the opening and a tab slidably mounted to the flange, wherein the tab is movable between a released position where the tab does not obstruct the cable from moving through the opening and an engaged position where the tab blocks the opening to prevent the cable from moving through the opening and thereby retain the sliding door in the door open position or in the door closed position.

The damper can be provided, wherein the damper can selectively apply a drag force on at least one of the pulley, the cable, and the counterweight to control the travel of the sliding door during movement of the sliding door from the door open position to the door closed position. The damper can apply a compression force to the cable to control the movement of the sliding door. The damper can include a U-shaped member which surrounds the cable and pinches the cable between at least one of the damper, the cover, and the door frame.

DETAILED DESCRIPTION

Figure 1:
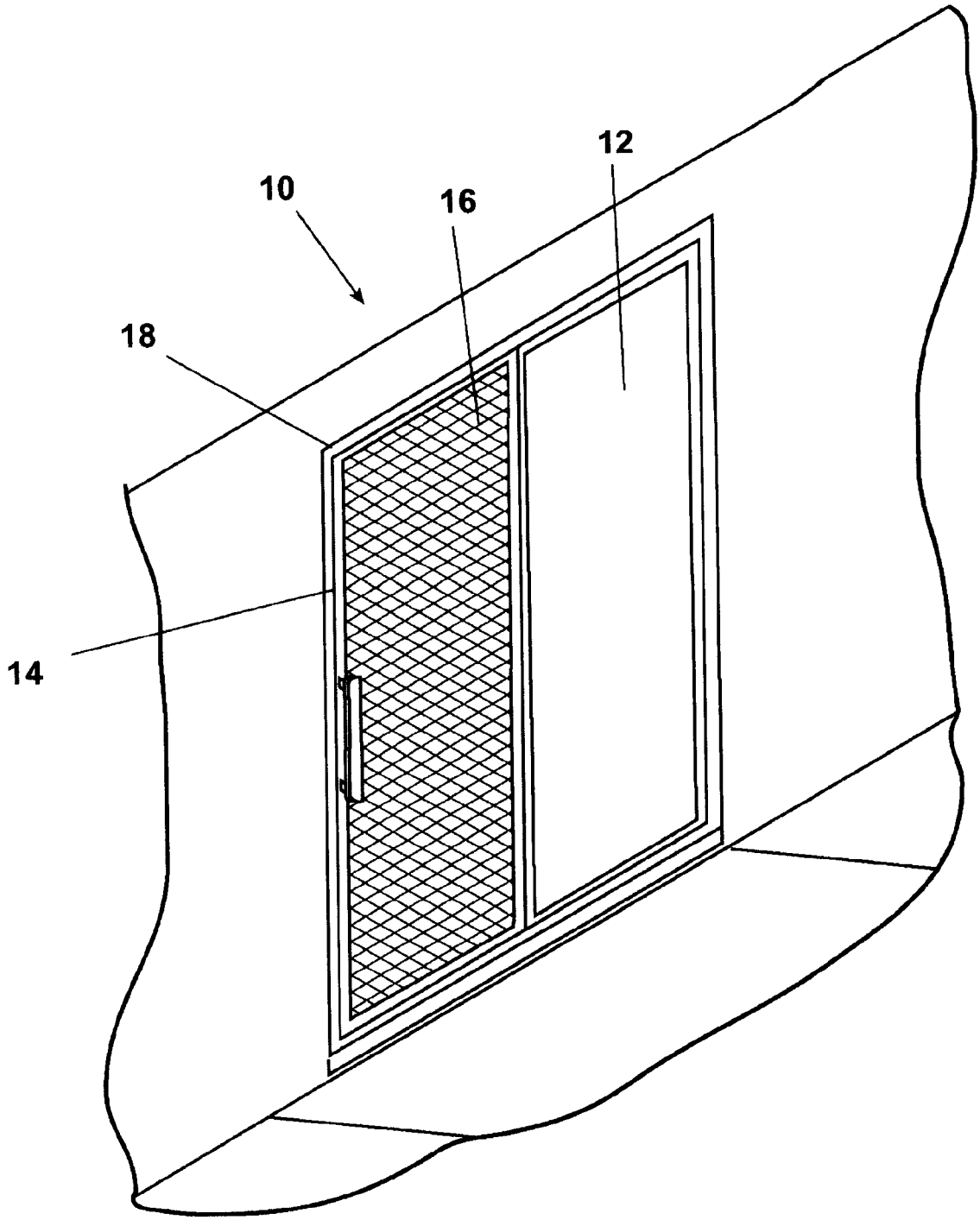
FIG. 1 is a fragmentary, perspective view of a conventional sliding glass door in a closed position, wherein the sliding glass door includes an automatically-closing screen door according to the invention.
Figure 2:
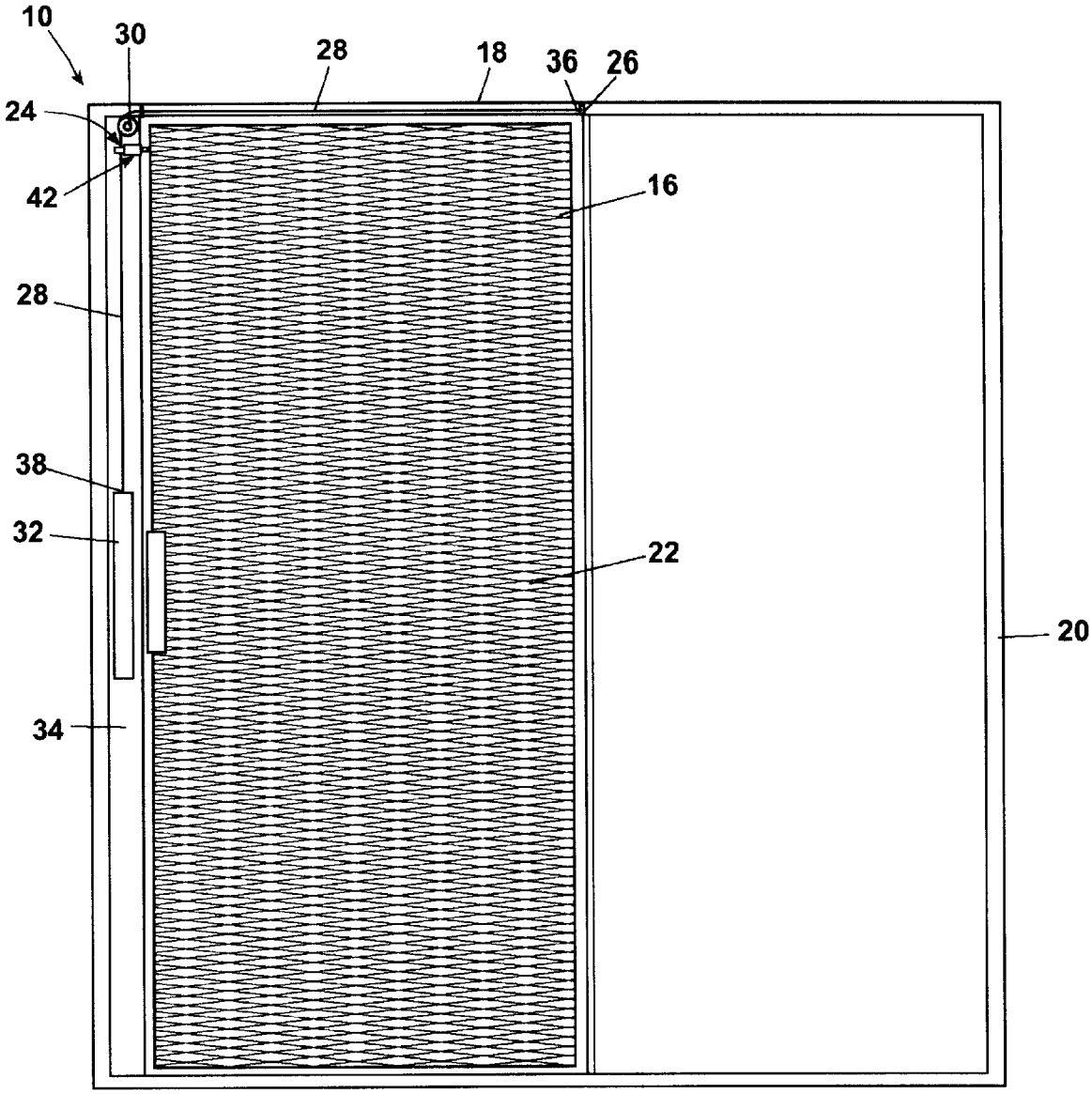
FIG. 2 is a front elevational view of a first embodiment of the automatically-closing screen door of FIG. 1 in a closed position.
Figure 3:
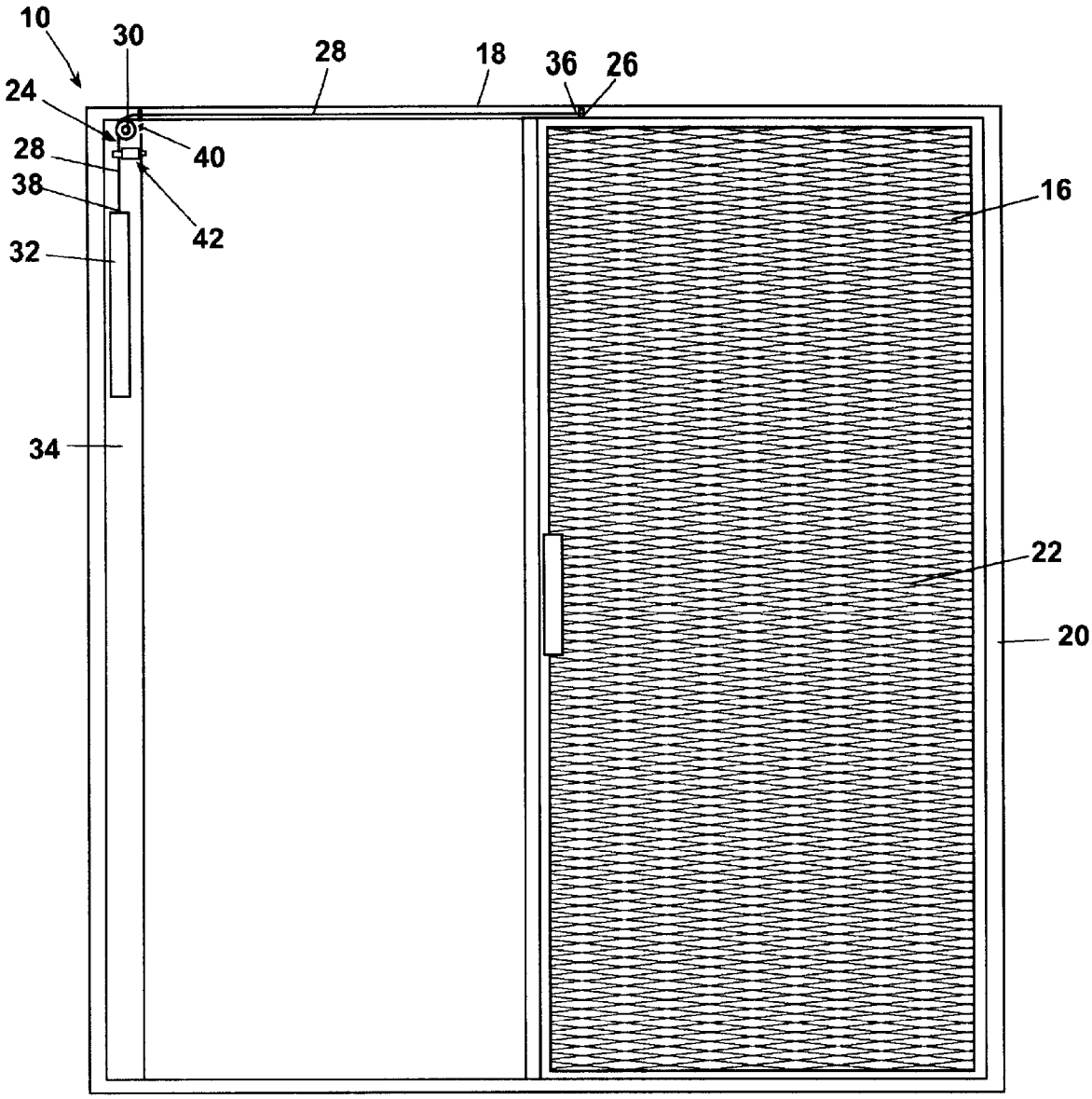
FIG. 3 is a front elevational view of the first embodiment of the automatically-closing screen door of FIG. 1 in an open position.

Referring now to the drawings and to FIGS. 1–3 in particular, a sliding door assembly 10 (often referred to by those skilled in the art as a "patio" door) is shown comprising a fixed door 12, a sliding glass door 14 and a sliding screen door 16 mounted within a door frame 18. It will be understood that the sliding glass door 14 and the sliding screen door 16 are mounted for slidable movement with respect to the door frame 18 in any suitable fashion which will be apparent to one skilled in the art so that further description of the particulars of the slidable mounting of the doors 14 and 16 is not necessary.

With particular reference to FIGS. 2 and 3, the screen door 16 is shown in greater detail in a closed position and an open position, respectively. The screen door 16 is a conventional door comprising a generally rectangular frame 20 with a taut mesh screen 22 therebetween.

In accordance with the invention, a first embodiment of an automatic closure system 24 is mounted between the sliding glass door frame 18 and the screen door 16. The automatic closure system 24 comprises a bracket 26, a cable 28, a pulley 30, a counterweight 32 and a cover 34.

The bracket 26 is preferably mounted to an upper portion of the screen door 16. The pulley 30 is preferably mounted to the cover 34 in generally horizontal planar alignment with the bracket 26. A first end 36 of the cable 28 is mounted to the bracket 26 at the upper portion of the screen door 16. A second end 38 of the cable 28 is mounted to the counterweight 32. As can be seen in FIGS. 2 and 3, the cable 28 is fed over the pulley 30 so that the counterweight is hung generally vertically by the second end 38 of the cable 28 and the first end 36 of the cable imparts a closure force on the screen door 16. The cover 34 is mounted over the pulley 30, the second end 38 of the cable 28, and the counterweight 32. Preferably, the cover 34 has an opening 40 at an upper end thereof for uninterrupted passage of the cable 28 as the door moves between the open and closed positions.

The bracket 26 can be any suitable bracket or fastener for connecting the first end 36 of the cable 28 to the screen door.

The cable 28 can be made of any suitable material including, but not limited to, nylon.

The pulley 30 can be any conventional wheel-type pulley or other suitable member, such as an eyelet, looped fastener, sleeve, etc. which performs the function of redirecting the cable 28 from a generally horizontal orientation at the first end 26 to a generally vertical orientation at the second end 38 thereof.

The counterweight 32 is any suitable weight, although it has been found that an elongated, thin weight member (e.g., a thin lead plate or rod) works best because it has a thin profile and can be mounted within the cover 34 without interrupting the visual aesthetics or functional operation of any components of the door assembly 10.

The cover 34 is preferably a low-profile sheath that conceals the interior components of the automatic closure system 24. The cover 34 is also preferably elongated a sufficient extent to conceal the interior components of the automatic closure system 24 regardless of the length of travel of the counterweight 32 (e.g., at least three feet for a 36-inch screen door 16 plus the length of the counterweight 32). It will also be understood that complex pulley arrangements can be substituted for the pulley 30 without departing from the scope of this invention. For example, a complex pulley system (such as that found in compound bows) can be substituted for the pulley 30 whereby a shorter cover 34 can be employed because the length of travel of the cable 28 would be reduced as a result of the complex pulley arrangement.

Figure 4:
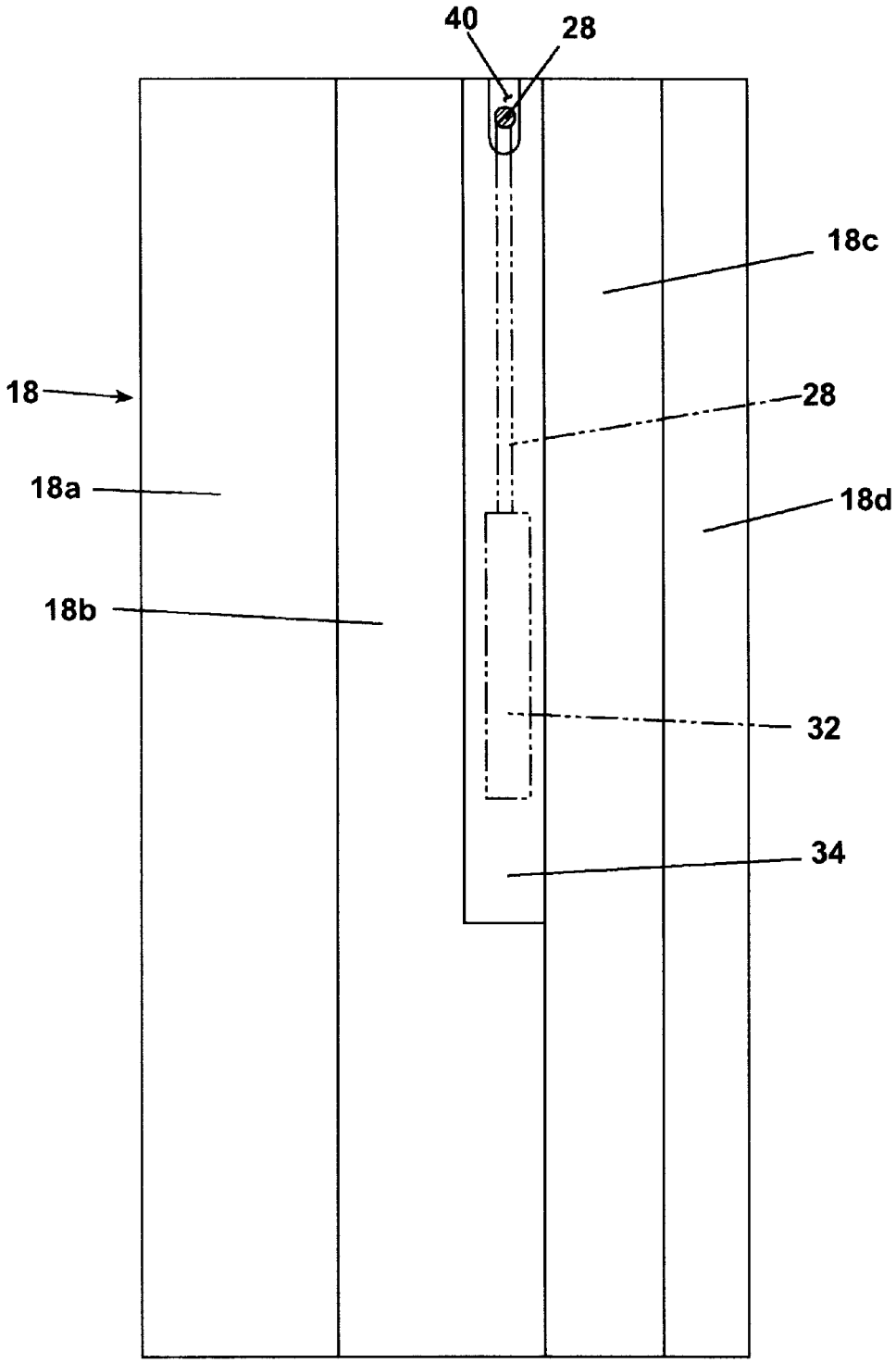
FIG. 4 is a side elevational view of a door jamb portion of the sliding glass door of FIG. 1 showing a portion of the first embodiment of the automatically-closing screen door of FIG. 1.

The mounting of the cover 34 is also shown in FIG. 4 on a portion of the door frame 18 comprising a sliding glass door jamb 18*a*, a fixed glass door jamb 18*b*, a screen door jamb 18*c* and an exterior door jamb portion 18*d*. As can be seen, while any location on the door frame 18 would be appropriate, it is preferred that the cover 34 (and the associated automatic door closure system 24) be located on the fixed glass door jamb 18*b* since the offset nature of the fixed glass door 12 with respect to the slidable glass door 14 provides a degree of clearance into which the automatic door closure system 24 can be mounted.

The use of the automatic closure system 24 associated with the screen door 16 is simple. When the screen door 16 is in the closed position (see FIG. 2), an occupant may grasp a suitable handle portion (not shown) on the screen door and laterally slide the screen door 16 with respect to the door frame 18 to the open position as shown in FIG. 3. The occupant moves the screen door 16 to the open position as shown in FIG. 3 against the counterweight 32 which is moved to a raised position as shown in the drawings. When the occupant has entered or exited through the door frame 18 as desired (i.e., by passing through the void left by the opened screen door 16), the occupant need merely release the occupant's grasp on the screen door 16 at which time the counterweight falls by gravity to a lowered position, returning the screen door 16 to the closed position as shown in FIG. 2.

It will be understood that the particular poundage making up the counterweight 32 can be selected to return the screen door 16 from the open position to the closed position at a predetermined rate. In addition, the counterweight 32 can be preselected or optionally adjusted with additional or fewer weights depending upon the friction imparted by the screen door 16 on its associated track during slidable movement of the screen door 16 relative to the door frame 18. That is, the smoother or rougher the movement of the screen door 16 relative to its associated track, the less or more weight may be required for the counterweight 32 to close the door in a desirable rate and fashion.

Figure 5:
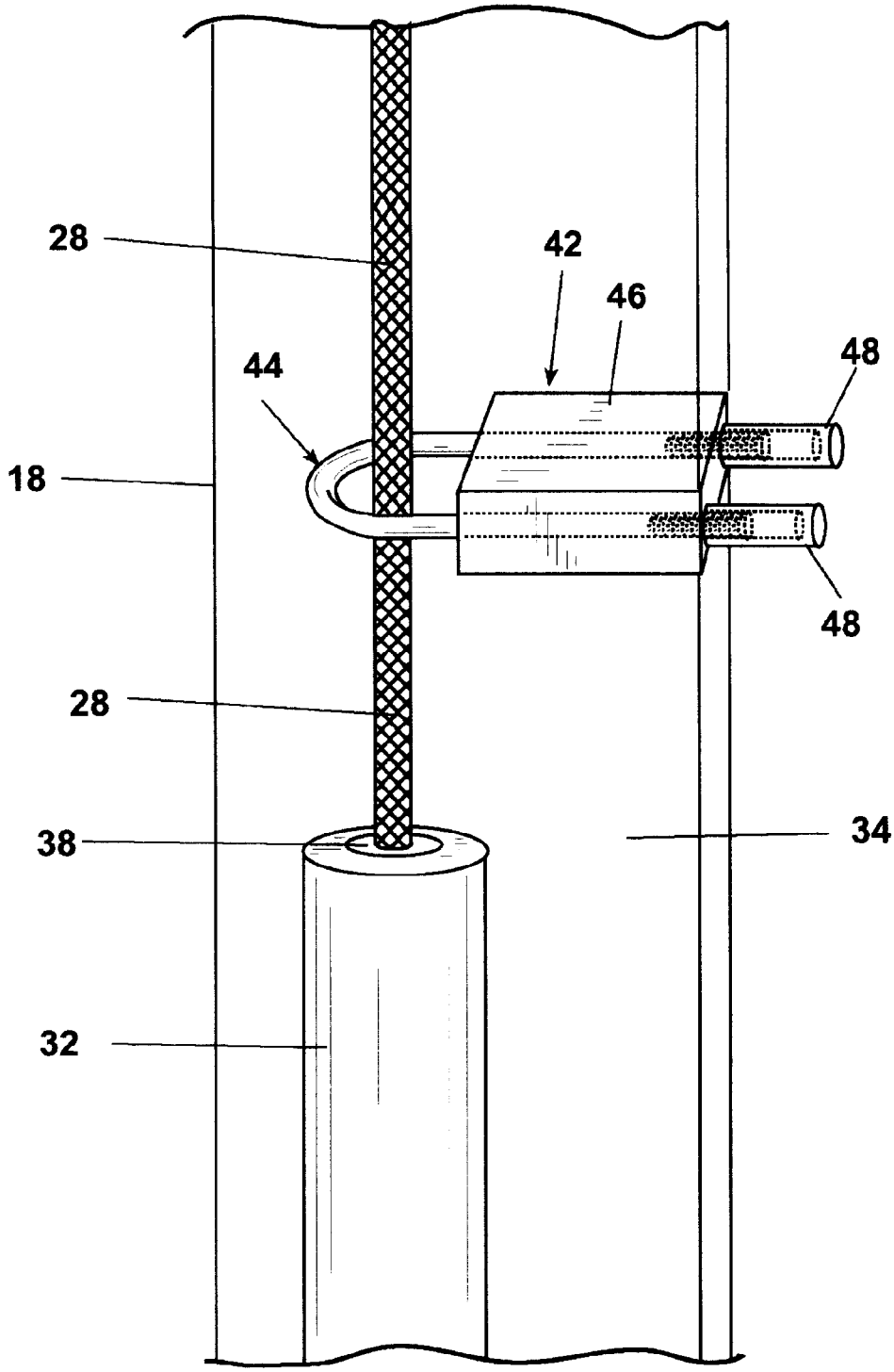
FIG. 5 is a side elevational view of a closing force adjuster for use with the automatically-closing screen door of FIG. 1.

In addition to varying the weight of the counterweight 32, the invention also contemplates the provision of an adjuster 42 which varies the drag encountered by the cable 28 as the screen door 16 moves between the opened and closed positions. The adjuster 42 is shown in FIGS. 2 and 3 and in greater detail in FIGS. 5–7.

The adjuster 42 comprises a U-shaped member 44 which is fastened to a housing 46 which, in turn, is mounted to the door frame 18 or the cover 34. The U-shaped member 44 can be selectively moved toward or away from the housing 46. In assembly, the cable 28 is passed through the arms of the U-shaped member 44 so that the cable 28 is selectively intertwined with the U-shaped member 44. As the U-shaped member 44 is tightened onto the housing 46 (such as by thumb screws 48 shown in FIG. 5), the cable 28 is trapped between the housing 46 and an interior surface of the U-shaped member 44. The varying force of the adjuster 42 is shown by the various positions of the U-shaped member 44 with respect to the housing 46 in FIGS. 6 and 7.

Figure 6:
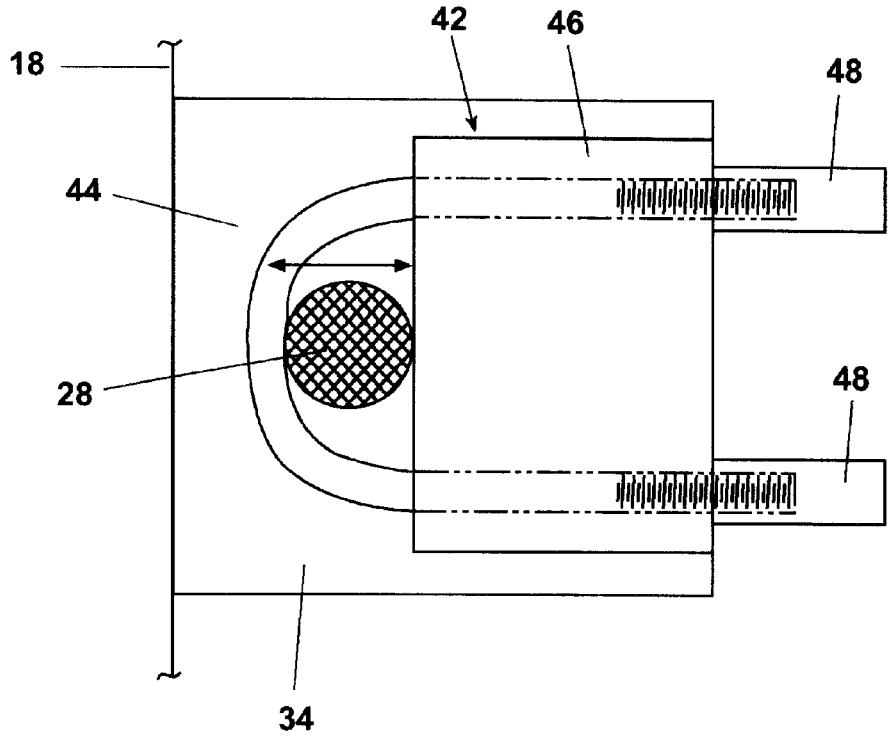
FIG. 6 is a top plan view of the closing force adjuster of FIG. 5 for use with the automatically-closing screen door of FIG. 1.
Figure 7:
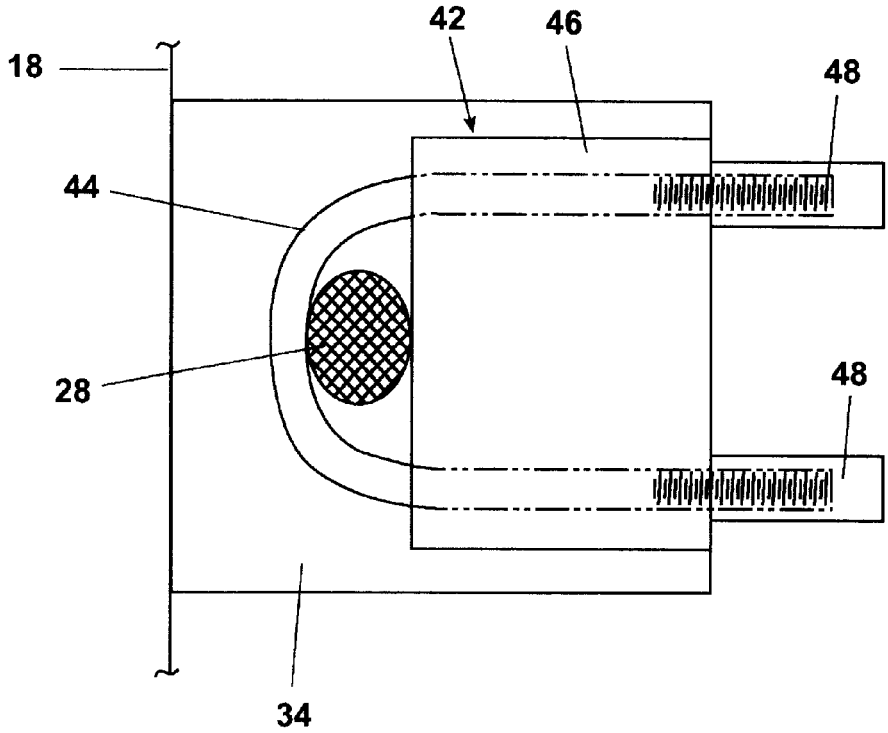
FIG. 7 is a top plan view of the closing force adjuster of FIG. 5 shown compressing a return cable, thus applying an additional drag to the closure of the screen door.

As the U-shaped member 44 is further tightened against the housing 46, the U-shaped member 44 restricts the movement of the cable 28 therethrough, causing the screen door 16 to close more slowly (see FIG. 7). Conversely, as the U-shaped member 44 is positioned away from the housing 46 (such as by loosening the thumb screws 48 as shown in FIG. 6), the U-shaped member does not contact the cable 28, causing the screen door 16 to close with the weight of the counterweight 32 and thus close more quickly than if the adjuster 42 was applying drag to the cable 28 as described.

Of course, the U-shaped member 44 can also be positioned sufficiently far from the housing 46 so that the U-shaped member 44 and the housing 46 do not contact the cable 28 whatsoever, thus providing no additional drag to the cable 28.

Figure 8:
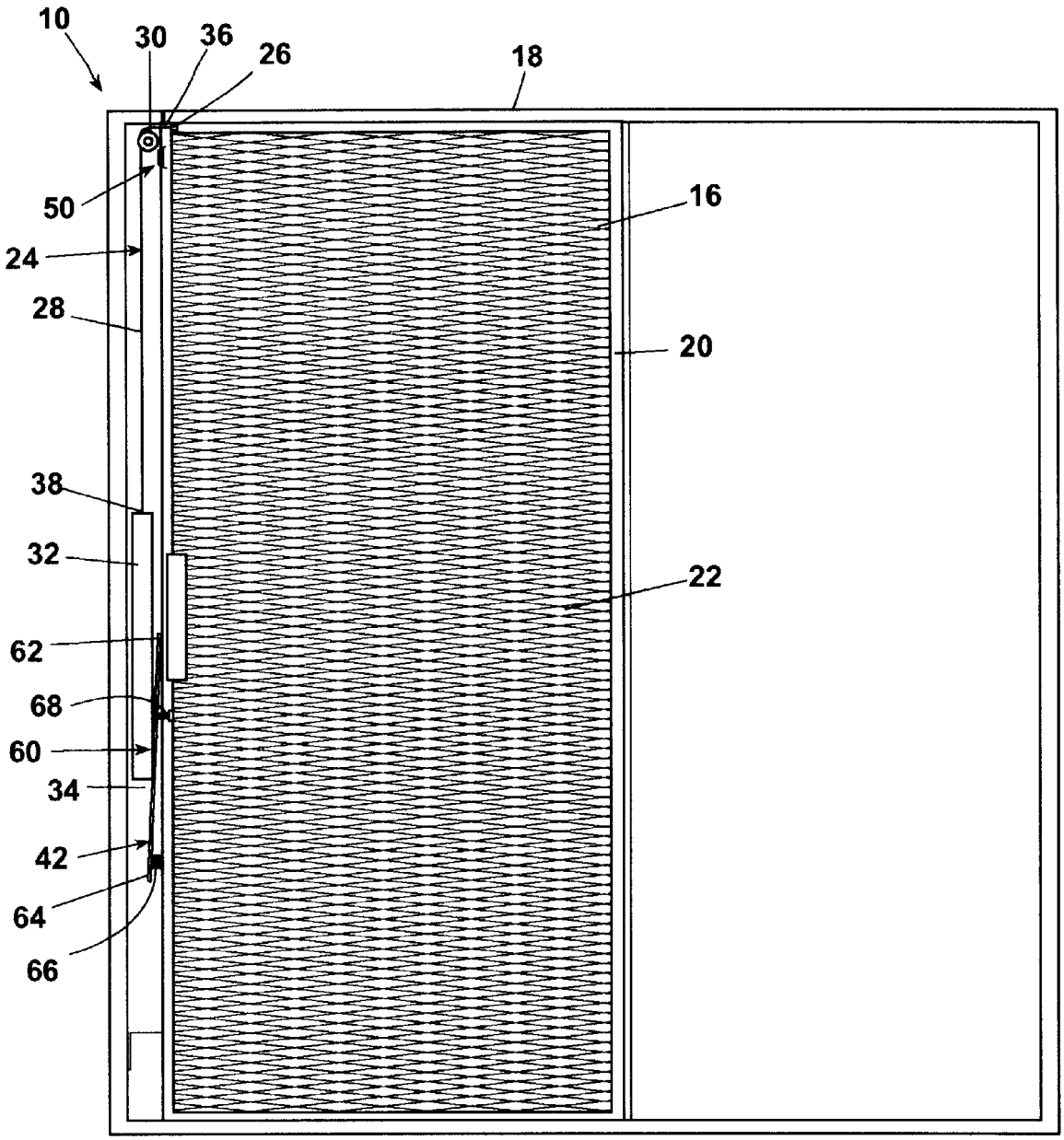
FIG. 8 is a front elevational view of a second embodiment of the automatically-closing screen door of FIG. 1 in a closed position.
Figure 9:
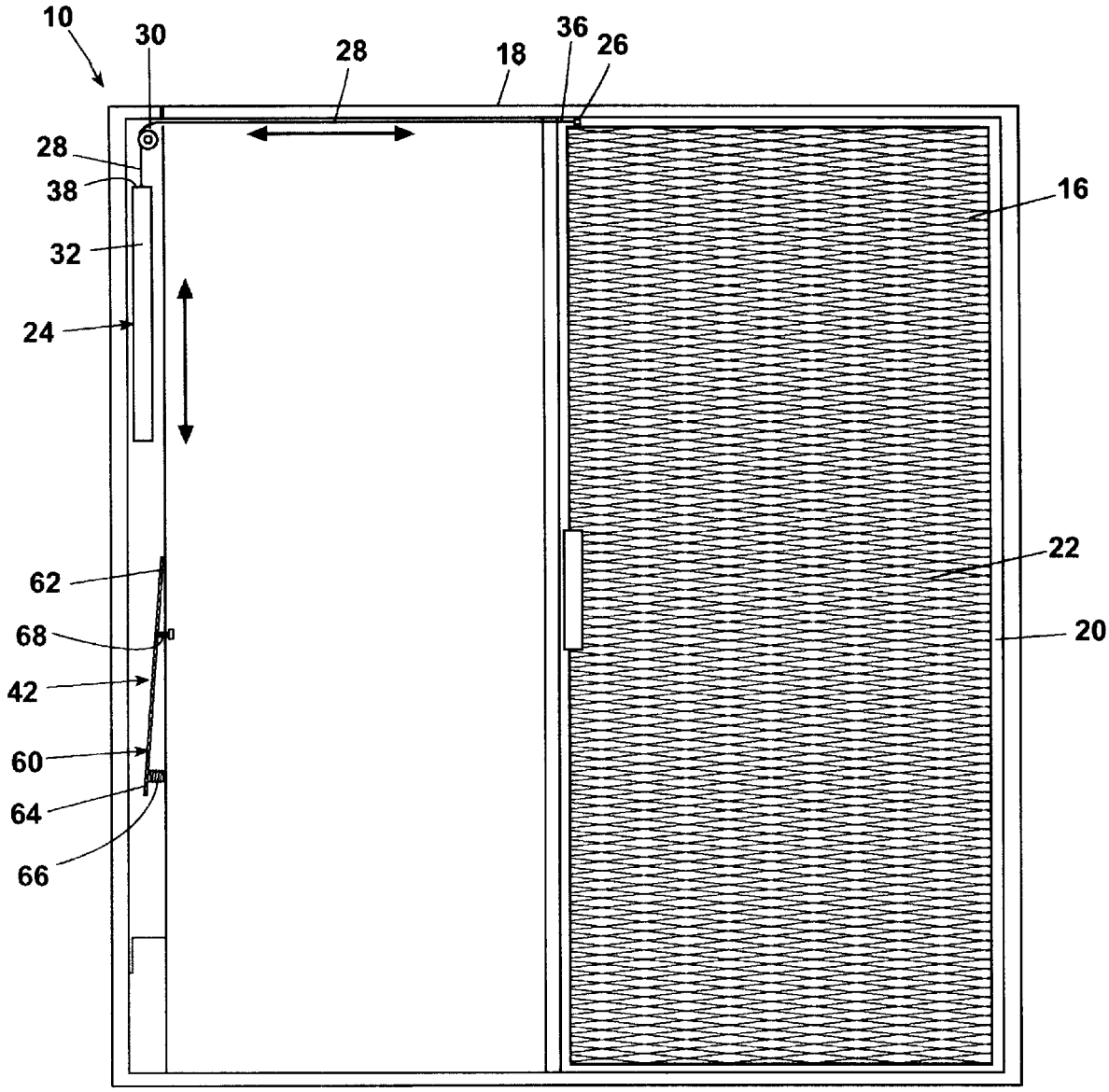
FIG. 9 is a front elevational view of the second embodiment of the automatically-closing screen door of FIG. 1 in an open position.

Also in accordance with the invention, a second embodiment of an automatic closure system 24 is shown in FIGS. 8–9 in which elements of the second embodiment of FIGS. 8–9 which have a corresponding structure and/or function in FIGS. 1–7 are referred to by like reference numerals.

The second embodiment of the automatic closure system 24 also includes a counterweight 32 located within a suitable cover 34, however, in this embodiment, the adjuster 42 for controlling the closing speed of the screen door 16 comprises an arm 60 having a first end 62 mounted to an interior portion of the cover 34 and a second end 64 extending inwardly therefrom in register with an axial path of travel of the counterweight 32 between the open and closed positions of the door.

Preferably, the arm 60 is mounted so that the second end 64 thereof is positioned to abut the counterweight 32 as it moves toward the closed position of the screen door 16. The second end 64 of the arm 60 can be biased into the counterweight travel path by a spring 66, preferably mounted between the second end 64 of the arm 60 and the cover 34. Preferably, the arm 60 is mounted to the cover 34 at a desirable vertical height so that the counterweight 32 contacts the arm 60 during its travel as the screen door 16 moves between the open and closed positions.

It will be understood that the spring 66 is optional, and that the arm 60 can also be made from a material which has an inherent resiliency so that some resistance/damping is imparted to the counterweight 32 by the arm 60 when the screen door, and thus the counterweight 32, moves between the open and closed positions.

A bias adjuster 68 is provided with the arm 60 for adjusting the amount of bias, and thus the amount of damping force, applied against the movement of the counterweight 32 between the open and closed positions. An example of the bias adjuster 68 is shown in FIGS. 8–9 as a threaded fastener passed through the cover 34 and contacting the arm 60 between the first and second ends 62 and 64 thereof. Thus, it can be seen that inward and outward axial movement of the bias adjuster 68 relative to the arm 60 can increase and decrease, respectively, the amount of force required by the counterweight 32 to deflect the arm 60 during movement of the screen door 16 between the open and closed positions.

The use of the second embodiment of the automatic closure system 24 for a screen door 16 will now be described. Initially, the door is typically in a closed position as shown in FIG. 8. A user will open the door by slidably moving the screen door 16 (in a rightward direction in the orientation shown in FIGS. 8–9), thus causing the cable 28 to lift the counterweight 32 via the pulley 30. The screen door 16, once opened, is in the position as shown in FIG. 9. Once the user has egressed through the door opening, the user can release the screen door 16 which causes gravity to act on the counterweight 32, pulling the screen door 16 back toward the closed position as shown in FIG. 8.

During the travel of the screen door 16 from the open position (FIG. 9) to the closed position (FIG. 8), the counterweight 32 encounters the arm 60, typically some portion of the arm 60 between the first and second ends 62 and 64 thereof, depending upon the position of the bias adjuster 68. The counterweight 32 bears against the arm 60, and thus against the bias of the optional spring 66, which causes the second end 64 of the arm 60 to deflect toward the cover 34. The action of the arm 60 against the movement of the counterweight 32 slows the movement of the counterweight 32, and thus slows the closure movement of the screen door 16 to a desirable speed, which can be set by the user by position of the bias adjuster 68.

In the example shown in FIGS. 8–9, the closure speed of the screen door can be easily set by threadably rotating the fastener making up the bias adjuster 68. This threadable rotation of the bias adjuster 68 increases or decreases (depending upon the direction of rotation of the bias adjuster 68) the force applied by the arm 60 on the counterweight 32.

Figure 10:
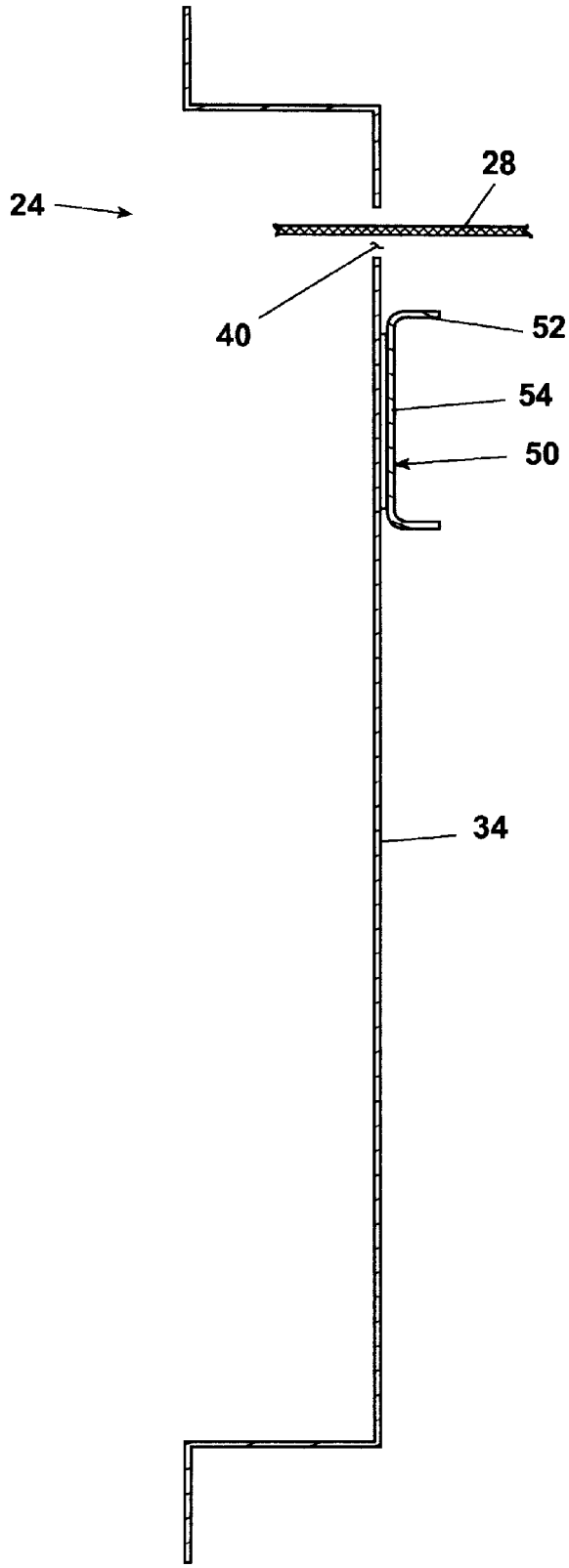
FIG. 10 is a cross-sectional view from a front elevational orientation in which a cover for the automatically-closing door of either the first or second embodiments is shown having a cable brake movably mounted thereto, wherein the cable brake is shown in a released position with respect to a cable therefor.
Figure 11:
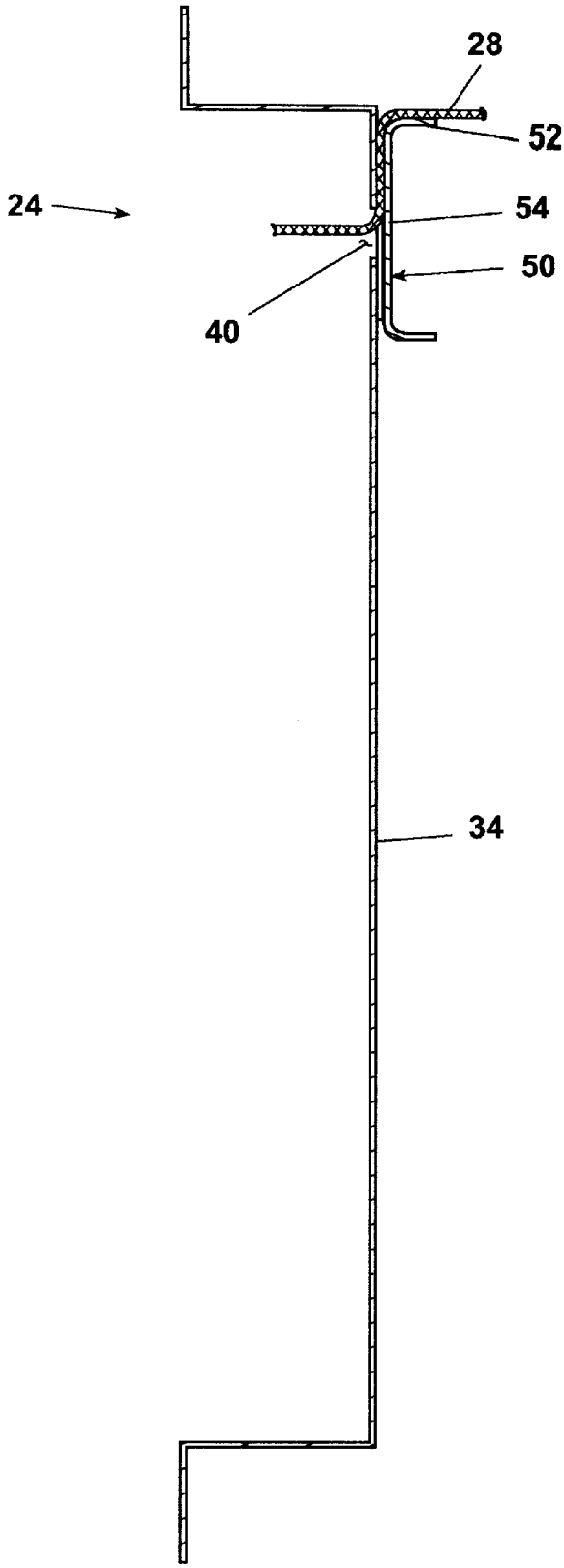
FIG. 11 is a cross-sectional view in an orientation similar to that of FIG. 10 in which the cable brake is shown in an engaged position thereby restricting movement of the cable with respect to the cover for the automatically-closing screen door of either the first or second embodiments.

Another feature of the automatic closure system 24 according to the invention is shown in FIGS. 10–11 in the form of a cable brake 50. The function of the cable brake 50 is to halt movement of the cable 28, preferably when the screen door 16 is in the open position. Thus, the counterweight 32 cannot draw the screen door 16 closed, allowing a user to essentially prop the screen door in the open position, such as during times when a large amount of item(s) need to be transported into and out of the screen door opening.

The cable brake 50 can be used with either of the first embodiment of FIGS. 1–7 or the second embodiment of FIGS. 8–9. As shown in FIGS. 10–11, the cable brake 50 comprises a tab 52 slidably mounted via a flange 54 to the cover 34. The tab 52 of the cable brake 50 is preferably movable between a released position as shown in FIG. 10 and an engaged position as shown in FIG. 11. In the released position, the tab 52 does not obstruct the cable 28 from passing through the opening 40 in the cover 34. In the engaged position, the tab 52 is slid upwardly so that the cable 28 is prevented from further travel through the opening 40, preferably by blocking the opening 40.

The tab 52 can be maintained in the engaged position of FIG. 11 by engagement of detents (not shown) on the tab 52 within recesses on the cover 34, although, as shown in FIG. 11, the tab 52 can simply create a friction lock of the cable 28 between the tab 52 and the cover 34 so that the cable 28 does not move into the opening 40 of the cover 34.

In use, if a user desires to prevent the automatic closure system 24 from operating, i.e., to prevent the counterweight 32 from drawing the screen door 16 from the open position to the closed position via the cable 28, the tab 52 is slid from the released position (FIG. 10) to the engaged position (FIG. 11) in which the cable 28 is prevented from traveling into the opening 40 of the cover 34. Thus, the screen door 16 stays in the open position. Once the user desires to close the screen door 16, the tab 52 is returned to the released position, thus loosening the grip on the cable 28 and permitting the counterweight 32 to continue drawing the screen door 16 to the closed position via the cable 28.

The invention overcomes the limitations of the prior art by offering simple manufacture, assembly and operation. It has a low profile relative to the door frame 18, has a low cost to manufacture and has little resistance when opening the sliding screen door unless the adjuster 42 or 68 and/or cable brake 50 is employed to provide additional resistance.

While the invention has been specifically described in connection with certain specific embodiments thereof, it is to be understood that this is by way of illustration and not of limitation, and the scope of the appended claims should be construed as broadly as the prior art will permit.

What is claimed is:

1. A door assembly comprising:

a door frame having a door jamb and defining a central opening therein through which ingress and egress can occur;

a door slidable in the door frame between a door open position permitting travel through the central opening and a door closed position obstructing travel through the central opening; and an automatic closure system comprising:

a cable with a first end and a second end, wherein the first end is mounted to an upper portion of the sliding door;

a counterweight connected at the second end of the cable and movable along a path between a counterweight open position when the sliding door is in the door open position and a counterweight closed position when the sliding door is in the door closed position, wherein the counterweight open position is above the counterweight closed position; and a pulley mounted to the door frame for redirecting the cable from a generally horizontal orientation near the first end to a generally vertical orientation near the second end; and an adjuster to control movement of the counterweight between the counterweight open and counterweight closed positions and comprising an arm having an end thereof fixedly mounted in relation to the frame and extending into the path of the counterweight;

wherein when a force is applied to the sliding door to cause the sliding door to slide to the door open position, the counterweight is elevated from the counterweight closed position along the path to the counterweight open position by virtue of the attachment of the cable to the sliding door via the pulley, and when the force is released, the arm abuts the counterweight and imparts a damping force to the counterweight as it descends along the path to the counterweight closed position to slow movement of the counterweight as it returns the sliding door to the door closed position.

2. The door assembly according to claim 1, wherein the automatic closure system further comprises a cover mounted on the door jamb to visually conceal the pulley, the second end of the cable, the counterweight, and the arm.

3. The door assembly according to claim 2, wherein the arm comprises a first end mounted to one of the cover and the door frame and a second end that extends into the path to abut the counterweight as it moves from the counterweight open position to the counterweight closed position.

4. The door assembly according to claim 3, wherein the adjuster further comprises a spring mounted between the one of the door frame and the cover and the arm to bias the arm toward the counterweight.

5. A kit for adapting a sliding door mounted within a door frame having a door jamb to automatically move between a door open position permitting travel therethrough and a door closed position obstructing travel therethrough, the kit comprising:

a cable with a first end and a second end, wherein the first end is adapted to be mounted to the sliding door;

a counterweight adapted to be connected at the second end of the cable and movable along a path between a counterweight open position when the sliding door is in the door open position and a counterweight closed position when the sliding door is in the door closed position;

a pulley adapted to be mounted to the door frame for redirecting the cable from a generally horizontal orientation near the first end to a generally vertical orientation near the second end; and an adjuster adapted to control movement of the counterweight between the counterweight open and counterweight closed positions and comprising an arm having an end thereof adapted to be fixedly mounted in relation to the frame and extending into the path of the counterweight;

wherein, when the pulley is mounted to the door frame and when the first end of the cable is mounted to the sliding door, passed through the pulley and has its second end mounted to the counterweight, the sliding door will automatically move between the door open position and the door closed position after a force is applied to the sliding door to cause the sliding door to move to the door open position whereby when the force is released, the arm abuts the counterweight and imparts a damping force to the counterweight as it descends along the path from the counterweight open position to the counterweight closed position to slow movement of the counterweight as it returns the sliding door to the door closed position.

6. The kit of claim 5 and further comprising a cover adapted to be mounted on the door jamb to visually conceal the pulley, the second end of the cable, the counterweight, and the arm.

7. The kit according to claim 6, wherein the arm comprises a first end adapted to be mounted to one of the cover and the door frame and a second end adapted to extend into the path to abut the counterweight as it moves from the counterweight open position to the counterweight closed position.

8. The kit according to claim 7, wherein the adjuster further comprises a spring adapted to be mounted between the one of the door frame and the cover and the arm to bias the arm toward the counterweight.

9. A door assembly comprising:

a door frame having a door jamb and defining a central opening therein through which ingress and egress can occur;

a door slidable in the door frame between a door open position permitting travel through the central opening and a door closed position obstructing travel through the central opening; and an automatic closure system comprising:

a cable with a first end and a second end, wherein the first end is mounted to an upper portion of the sliding door;

a counterweight connected at the second end of the cable and movable between a counterweight open position when the sliding door is in the door open position and a counterweight closed position when the sliding door is in the door closed position, wherein the counterweight open position is above the counterweight closed position;

a pulley mounted to the door frame for redirecting the cable from a generally horizontal orientation near the first end to a generally vertical orientation near the second end;

a cover mounted on the door jamb to visually conceal the pulley, the second end of the cable, and the counterweight; and an adjuster to control movement of the counterweight between the counterweight open and counterweight closed positions and comprising an arm having a first end mounted to the cover and a second end that extends towards the door jamb and abuts the counterweight as it moves between the counterweight open and counterweight closed positions; and wherein when a force is applied to the sliding door to cause the sliding door to slide to the door open position, the counterweight is elevated from the counterweight closed position to the counterweight open position by virtue of the attachment of the cable to the sliding door via the pulley, and when the force is released, the counterweight descends to the counterweight closed position thereby returning the sliding door to the door closed position; and wherein the second end of the arm imparts a damping force onto the counterweight as it moves between the counterweight open and counterweight closed positions, thereby causing the sliding door to move more slowly between the door open position and the door closed position.

10. The door assembly of claim 9, wherein the adjuster further comprises a bias adjuster to control the damping force imparted onto the counterweight by the arm.

11. The door assembly of claim 10, wherein the bias adjuster comprises a threaded fastener that is mounted through the cover and contacts the arm between the first and second ends of the arm so that movement of the threaded fastener towards the arm increases the amount of damping force exerted by the arm and movement of the threaded fastener away from the arm decreases the amount of damping force exerted by the arm.

12. The door assembly of claim 9, wherein the arm is comprised of a resilient material.

13. The door assembly of claim 9, wherein the adjuster further comprises a spring mounted between the cover and the second end of the arm, wherein the spring biases the arm towards the counterweight.

14. A kit for adapting a sliding door mounted within a door frame having a door jamb to automatically move between a door open position permitting travel therethrough and a door closed position obstructing travel therethrough, the kit comprising:

a cable with a first end and a second end, wherein the first end is adapted to be mounted to the sliding door;

a counterweight adapted to be connected at the second end of the cable and movable between a counterweight open position when the sliding door is in the door open position and a counterweight closed position when the sliding door is in the door closed position;

a pulley adapted to be mounted to the door frame for redirecting the cable from a generally horizontal orientation near the first end to a generally vertical orientation near the second end;

a cover adapted to be mounted on the door jamb, wherein when the cover is mounted on the door jamb, the pulley, the second end of the cable, and the counterweight are visually concealed; and an adjuster to control movement of the counterweight between the counterweight open and counterweight closed positions and comprising an arm having a first end adapted to be mounted to the cover and a second end;

wherein, when the pulley is mounted to the door frame and when the first end of the cable is mounted to the sliding door, passed through the pulley and has its second end mounted to the counterweight, the sliding door will automatically move between the door open position and the door closed position after a force is applied to the sliding door to cause the sliding door to move to the door open position whereby when the force is released, the counterweight descends to the counterweight closed position thereby moving the sliding door to the door closed position; and wherein when the cover is mounted to the door jamb and the first end of the arm is mounted to the cover, the second end of the arm extends towards the door jamb and abuts and imparts a damping force onto the counterweight as it moves between the counterweight open and counterweight closed positions, thereby causing the sliding door to move more slowly between the door open position and the door closed position.

15. The kit of claim 14, wherein the adjuster further comprises a bias adjuster to control the damping force imparted onto the counterweight by the arm.

16. The kit of claim 15, wherein the bias adjuster comprises a threaded fastener adapted to be mounted through the cover, wherein when the threaded fastener is mounted through the cover, the threaded fastener contacts the arm between the first and second ends of the arm, and movement of the threaded fastener towards the arm increases the amount of damping force exerted by the arm to the counterweight and movement of the threaded fastener away from the arm decreases the amount of damping force exerted by the arm to the counterweight.

17. The kit of claim 14, wherein the arm is comprised of a resilient material.

18. The kit of claim 14, wherein the adjuster further comprises a spring adapted to be mounted between the cover and the second end of the arm, wherein when the spring is mounted between the cover and the second end of the arm, the spring biases the arm towards the counterweight.

* * * * *